US007808191B2

(12) United States Patent
Wu

(10) Patent No.: US 7,808,191 B2
(45) Date of Patent: Oct. 5, 2010

(54) DIM CONTROL CIRCUIT DIMMING METHOD AND SYSTEM

(75) Inventor: Mingliang Wu, Schaumburg, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 707 days.

(21) Appl. No.: 11/813,351

(22) PCT Filed: Jan. 18, 2006

(86) PCT No.: PCT/IB2006/050185

§ 371 (c)(1),
(2), (4) Date: Jul. 5, 2007

(87) PCT Pub. No.: WO2006/077539

PCT Pub. Date: Jul. 27, 2006

(65) Prior Publication Data

US 2008/0203940 A1 Aug. 28, 2008

Related U.S. Application Data

(60) Provisional application No. 60/645,327, filed on Jan. 19, 2005.

(51) Int. Cl.
*H05B 37/00* (2006.01)

(52) U.S. Cl. ..... 315/307; 315/219; 315/DIG. 4

(58) Field of Classification Search ..... 315/307, 315/308, 224, 219, 247, DIG. 4, DIG. 5, 315/DIG. 7

See application file for complete search history.

(56) References Cited

U.S. PATENT DOCUMENTS

| | | | | |
|---|---|---|---|---|
| 4,016,451 | A | 4/1977 | Engel | |
| 4,197,485 | A | 4/1980 | Nuver | |
| 5,239,239 | A | 8/1993 | Biegel et al. | |
| 5,965,989 | A * | 10/1999 | Mader | 315/279 |
| 6,194,841 | B1 * | 2/2001 | Takahashi et al. | 315/224 |
| 6,969,959 | B2 * | 11/2005 | Black et al. | 315/307 |

FOREIGN PATENT DOCUMENTS

WO 03056884 A1 7/2003

OTHER PUBLICATIONS

Philips Application US040061, Fig. 1, 4, 5. p. 2, line 30 to 33, p.. 3, line 9, 10,20-22, 28, 29, p. 4, line 5-15, p. 5, lines 29-33, p. 6, line 1-5, p. 8, line 11-13, Jan. 21, 2004.

* cited by examiner

*Primary Examiner*—David Hung Vu

(57) ABSTRACT

A dim control circuit dimming method and system with a dimming ballast dim control circuit (148) includes a dimmer switch input (120) having a first terminal (154) and a second terminal (156), the dimmer switch input (120) operably connected to receive a dim signal (106); a power supply (124); a current limiter (126); and a coupler (128). The power supply (124), the current limiter (126), and the coupler (128) are connected in series between the first terminal (154) and the second terminal (156), and the coupler (128) generates a lamp dim control signal (132) when the first terminal (154) and the second terminal (156) are electrically connected.

20 Claims, 2 Drawing Sheets

DIM CONTROL CIRCUIT DIMMING METHOD AND SYSTEM

CROSS REFERENCE TO RELATED APPLICATION

This application claims the benefit of U.S. provisional application Ser. No. 60/645,327, filed Jan. 19, 2005, the entire subject matter of which is hereby incorporated by reference.

This invention relates generally to lamp dimming control, and more specifically to a method and system for lamp dimming.

Electronic ballasts have become more sophisticated with the addition of subsystems to handle a wide variety of lighting control needs, such as energy efficiency and remote dimming control. Such subsystems increase the complexity and add more electronics to the electronic ballast while requiring high quality and a limited form factor. Often, subsystems reside on separate daughter boards which connect to a main board for power. Large parts on daughter boards make ballasts difficult to manufacture, create undesirably large daughter board profiles, increase costs, and reduce quality due to poor mechanical connections.

In the area of dimmable electronic ballasts, common practice in a dimming control subsystem is to tap power from a high voltage, rectified output of the main board's half bridge circuit. Drawing power from such a high power source not only leads to crossing a noisy path from the main board, but also requires including heavy duty transformer and noise filtering circuitry to provide clean, low voltage DC signal. In summary, present dimmable electronic ballasts have a high number of parts, undesirable power connections to the main board, a large daughter board profile, poor manufacturability, and high production cost.

It would be desirable to provide a dim control circuit dimming method and system that overcomes the above disadvantages.

One aspect of the invention provides an electronic ballast lamp dim control circuit including a dimmer switch input having a first terminal and a second terminal; a power supply; a current limiter; and a coupler. The power supply, the current limiter, and the coupler are connected in series between the first terminal and the second terminal, and the coupler generates a lamp dim control signal when the first terminal and the second terminal are electrically connected.

Another aspect of the invention provides an electronic ballast lamp dimming control method including providing a lamp dim control circuit having a dimmer switch input, a power supply, a current limiter and a coupler connected in series; generating a loop current in the dim control circuit when the dimmer input is closed; and generating a lamp dim control signal at the coupler in response to the loop current.

Another aspect on the invention provides a lamp dimming control system including means for receiving a dimming signal; means for supplying power; and means for coupling. The receiving means, the power supplying means, and the coupling means are connected in series. The power supplying means generates a loop current in the coupling means when the dimmer input is closed and the coupling means generates a lamp dim control signal in response to the loop current.

The foregoing and other features and advantages of the invention will become further apparent from the following detailed description of the presently preferred embodiment, read in conjunction with the accompanying drawings. The detailed description and drawings are merely illustrative of the invention rather than limiting, the scope of the invention being defined by the appended claims and equivalents thereof.

Figure 1:
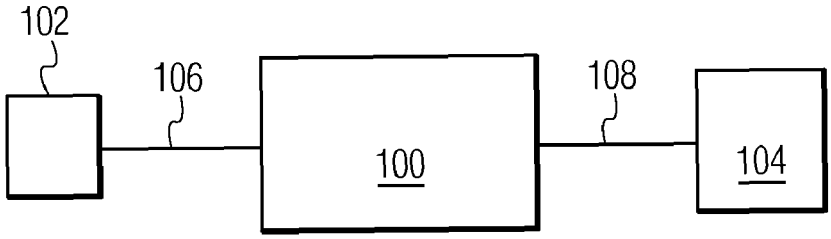
FIG. 1 is a block diagram of a lighting system with a dimmable electronic ballast made in accordance with the present invention.

FIG. 1 is a block diagram of a lighting system with a dimmable electronic ballast made in accordance with the present invention. A dimmer switch 102 provides a dim signal 106 to an electronic ballast 100, which is responsive to the dim signal 106 to provide a light output signal 108 to lamp 104. In one embodiment, the dimmer switch 102 alternately provides open and closed contacts so that the desired dim level is determined from sampling the relative time the contacts are open or closed. In an alternative embodiment, the dimmer switch 102 alternately provides open and closed contacts with the sum of concurrent open and closed times being a constant, and the desired dim level is determined from sampling the relative time the contacts are open or closed.

Figure 2:
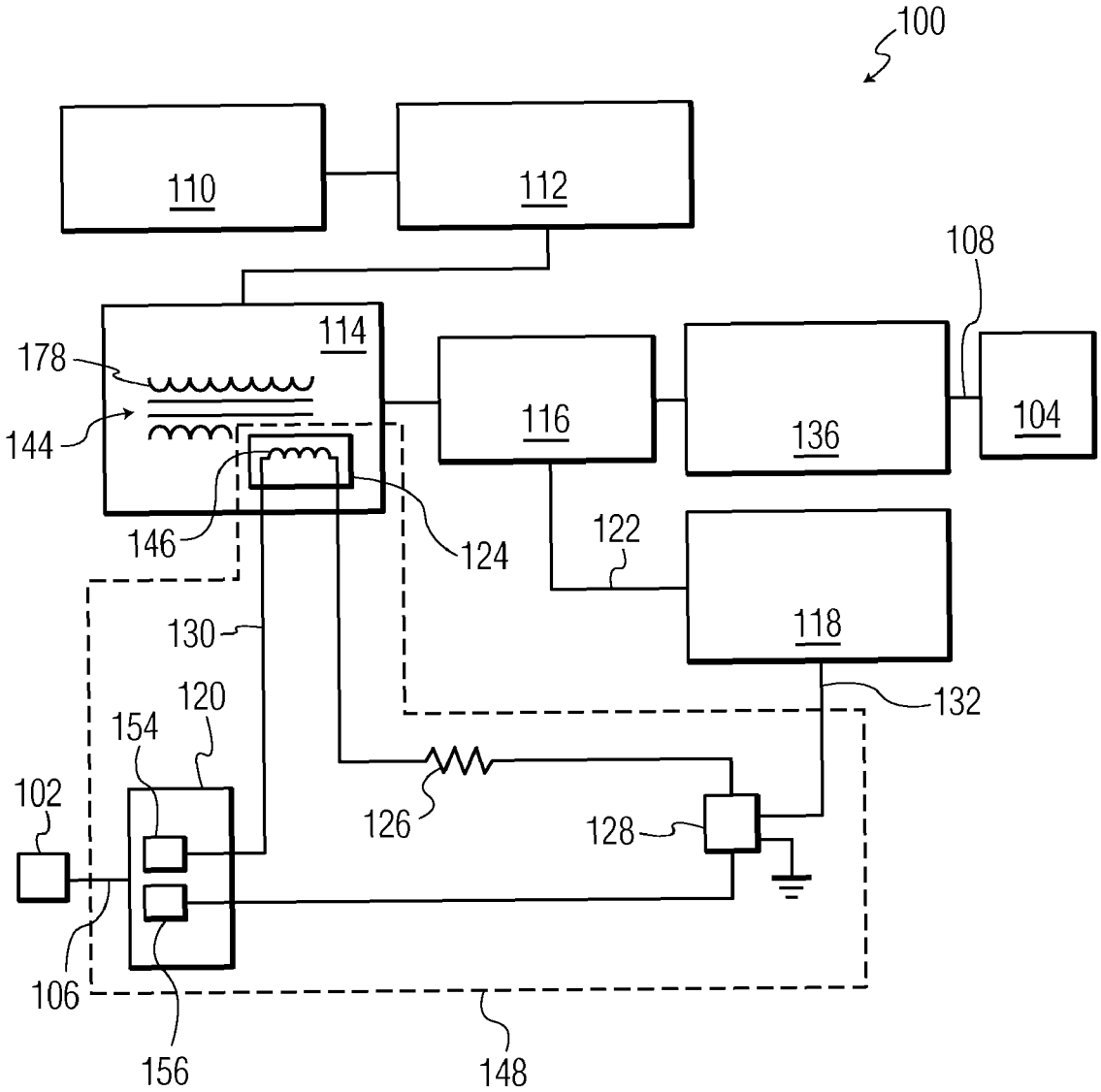
FIG. 2 is a block diagram of a dimmable electronic ballast with a dimming ballast dim control circuit made in accordance with the present invention.

FIG. 2 is a block diagram of a dimmable electronic ballast with a dimming ballast dim control circuit made in accordance with the present invention. Ballast 100 includes a mains voltage input 110, an AC/DC converter 112, a half bridge circuit 116, a resonant tank circuit 136, a power factor correction (PFC) circuit 114, a lamp controller 118, and dim control circuit 148. In this example, the dim control circuit 148 includes a secondary winding 146 of a transformer 144, a current limiter 126, a coupler 128, and a dimmer switch input 120 including first terminal 154 and second terminal 156. The transformer 144 has a primary winding 178 coupled to the secondary winding 146, and is part of the PFC circuit 114.

The mains voltage input 110 receives mains voltage from a mains power supply and provides the mains voltage to the AC/DC converter 112, which converts the mains voltage to a DC voltage. The PFC circuit 114 switches the output of the AC/DC converter 112 to establish the desired DC bus voltage at the half bridge circuit 116. The lamp controller 118 controls switching of the half bridge circuit 116 to set the high frequency AC voltage of the light output signal 108 from the resonant tank circuit 136 to the lamp 104.

In this example, the lamp dim control circuit 148 draws circuit power from the PFC circuit 114 at a secondary winding 146 of transformer 144. The power supply 124 is the secondary winding 146 of transformer 144. When the first terminal 154 and the second terminal 156 are electrically connected, i.e., when the dimmer switch contacts are closed, loop current 130 driven by the power supply 124 passes through the current limiter 126 and the coupler 128. The coupler 128 generates the lamp dim control signal 132 provided to the lamp controller 118 in response to the loop current 130.

Those skilled in the art will appreciate that the lamp dim control circuit 148 can be designed for particular applications as desired. The coupler 128 is any optical, capacitive, or inductive coupling device capable of generating the lamp dim control signal in response to the loop current and isolating the dimmer switch 102 from the lamp controller 118. In one embodiment, the coupler 128 is an optocoupler. In alternative embodiments, the coupler 128 is an integrated circuit device with serial data buffering, a repeater, or a Universal Asynchronous Receiver-Transmitter (UART). The power supply 124 is any power supply capable of generating the loop current 130 when the first terminal 154 and the second terminal 156 are electrically connected. In one embodiment, the power supply 124 is the secondary winding 146 of the transformer 144 included in the PFC circuit 114. In an alternative embodiment, the power supply 124 is a battery. In another alternative embodiment, the power supply 124 is an independent DC source in the electronic ballast, such as an electronic ballast standby DC power supply.

During operation, the lamp dim control circuit 148 detects the state of the dimmer switch 102 and generates the lamp dim control signal 132, corresponding to a percent lamp output. The span of the lamp dim control circuit 148 can be set so that the percent lamp output is between a low limit, such as 5% lamp output and a high limit, such as 100% lamp output. In one embodiment, the state of the dimmer switch 102 is whether the dimmer switch 102 is open or closed, disconnecting or connecting the first terminal 154 and the second terminal 156, respectively. The dimmer switch 102 alternately opens and closes, generating a square wave as the lamp dim control signal 132. The dimming level is determined by the lamp controller 118 from sampling the relative time the lamp dim control signal 132 is high or low. The signal timing can be set so that each cycle takes a given time. For example, the cycle time can be 8.3 msec with the dimmer switch 102 being closed for 5.5 msec and open for 2.8 msec for 100 percent lamp output. Similarly, the dimmer switch 102 is closed for 4.15 msec and open for 4.15 msec for 50 percent lamp output, and closed for 1.8 msec and open for 6.5 msec for 5 percent lamp output. In an alternative embodiment, the state of the dimmer switch 102 is the resistance across the dimmer switch 102, with the loop current 130 varying with the resistance. Those skilled in the art will appreciate that the lamp dim control circuit 148 can be designed to detect various states of the dimmer switch 102 to generate a lamp dim control signal as desired for a particular application. The dimmer switch 102 can vary closure timing or resistance to generate the loop current pattern or amplitude corresponding to the desired lamp output and to generate the lamp dim control signal 132. The lamp controller 118 is responsive to the pattern or amplitude of the lamp dim control signal 132 to generate the controller lamp signal 122.

Figure 3:
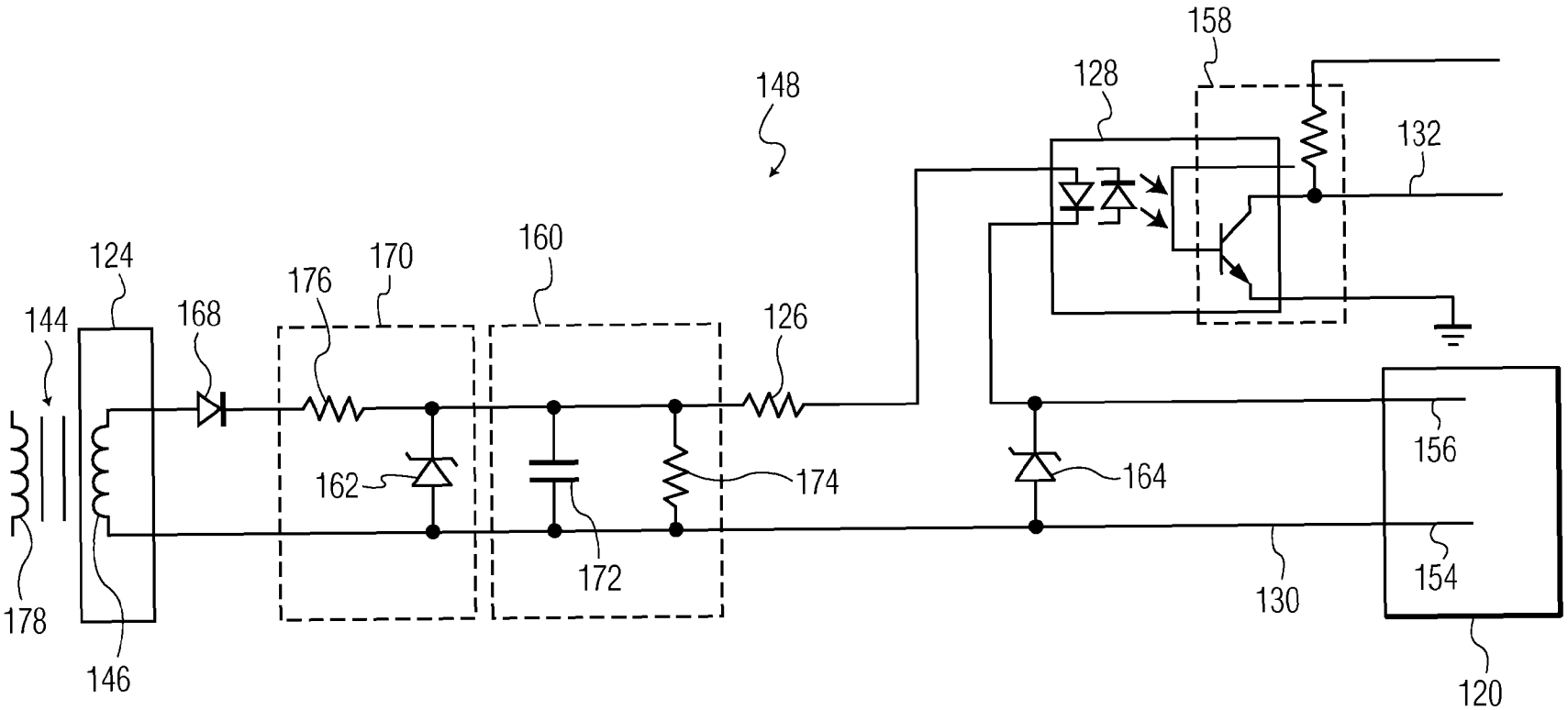
FIG. 3 is a schematic diagram of a dimming ballast dim control circuit made in accordance with the present invention.

FIG. 3, in which like elements share like reference numbers with FIG. 2, is a schematic diagram of a dimming ballast dim control circuit made in accordance with the present invention. Secondary winding 146 of transformer 144 is connected in series with current limiter 126 and input of coupler 128 between the first terminal 154 and the second terminal 156. The loop current 130 flows through the dim control circuit 148 when the first terminal 154 and the second terminal 156 are electrically connected. The output of coupler 128 is configured as low-side driver 158 to generate a lamp dim control signal 132 between 0 and 5 Volts. The coupler 128 in this example is an AC sensing phototransistor output optocoupler, although a DC sensing phototransistor output optocoupler can be used in this embodiment because the loop current 130 only flows in one direction.

The exemplary dim control circuit 148 shown provides additional optional components for circuit protection and signal conditioning. Spiking prevention at the power supply 124 is provided by spiking prevention circuit 170 including resistor 176 connected in series with the secondary winding 146 of transformer 144 and the input of coupler 128, in combination with Zener diode 162 connected in parallel across the secondary winding 146 of transformer 144. Noise limitation is provided by noise filter 160 including capacitor 172 and resistor 174 connected in parallel across the secondary winding 146 of transformer 144. In alternative embodiments, the noise filter can be a noise filtering integrated circuit. Spiking prevention at dimmer switch input 120 is provided by Zener diode 164 connected in parallel across the dimmer switch input 120. Those skilled in the art will appreciate that the additional components can be included or omitted as desired for a particular application. For example, rectifying diodes, such as diode 168, can be connected in series with the secondary winding 146 of transformer 144 and the input of coupler 128 to rectify voltage from the power supply 124 when the power from the power supply 124 is noisy or includes AC components. Additional resistors can be connected in series with the current limiter 126 to further limit the loop current 130 or to divide the voltage drop across the individual resistors.

While the embodiments of the invention disclosed herein are presently considered to be preferred, various changes and modifications can be made without departing from the scope of the invention. Those skilled in the art will appreciate that the embodiments described for FIGS. 1-3 are exemplary and that alternative circuits can be used as desired for particular applications. The scope of the invention is indicated in the appended claims, and all changes that come within the meaning and range of equivalents are intended to be embraced therein.

The invention claimed is:

1. A lamp dim control circuit 148 for an electronic ballast comprising:
   - a dimmer switch input 120 having a first terminal 154 and a second terminal 156, the dimmer switch input 120 operably connected to receive a dim signal 106;
   - a power supply 124;
   - a current limiter 126; and
   - a coupler 128;
   - wherein the power supply 124, the current limiter 126, and the coupler 128 are connected in series between the first terminal 154 and the second terminal 156, and the coupler 128 generates a lamp dim control signal 132 when the first terminal 154 and the second terminal 156 are electrically connected.

2. The circuit of claim 1 wherein the power supply 124 comprises a secondary winding 146 of a transformer 144.

3. The circuit of claim 2 wherein a power factor control circuit 114 includes the transformer 144.

4. The circuit of claim 1 wherein the power supply 124 is selected from the group consisting of a battery and a standby DC power supply.

5. The circuit of claim 1 wherein the coupler 128 is an optocoupler.

6. The circuit of claim 1 wherein the coupler 128 is selected from the group consisting of an integrated circuit device with serial data buffering, a repeater, and a Universal Asynchronous Receiver-Transmitter (UART).

7. The circuit of claim 1 further comprising a rectifier 168 connected in series with the power supply 124 and the current limiter 126.

8. The circuit of claim 1 further comprising a noise filter 160 connected in parallel with the power supply 124.

9. The circuit of claim 1 further comprising a spiking prevention circuit 170 connected in parallel with the power supply 124.

10. The circuit of claim 1 further comprising a Zener diode 164 connected in parallel with the dimmer switch input 120.

11. A lamp dimming control method for an electronic ballast comprising:
   - providing a lamp dim control circuit having a dimmer input, a power supply, a current limiter, and a coupler connected in series;

generating a loop current in the lamp dim control circuit when the dimmer input is closed; and generating a lamp dim control signal at the coupler in response to the loop current.

12. The method of claim 11 further comprising limiting the loop current.

13. The method of claim 11 further comprising rectifying voltage at the power supply.

14. The method of claim 11 further comprising limiting noise from the power supply.

15. The method of claim 11 further comprising receiving power at the power supply from a power factor correction circuit.

16. A lamp dimming control system comprising:

means for receiving a dimming signal;

means for supplying power; and means for coupling;

wherein the receiving means, the power supplying means, and the coupling means are connected in series, the power supplying means generates a loop current in the coupling means when the dimmer input is closed, and the coupling means generates a lamp dim control signal in response to the loop current.

17. The system of claim 16 further comprising means for limiting the loop current.

18. The system of claim 16 further comprising means for rectifying voltage from the power supplying means.

19. The system of claim 16 further comprising means for limiting noise from the power supplying means.

20. The system of claim 16 further comprising means for receiving power at the power supplying means from a power factor correction circuit.

* * * * *